US011065484B2

(12) United States Patent
Bakhos

(10) Patent No.: US 11,065,484 B2
(45) Date of Patent: Jul. 20, 2021

(54) PORTABLE FIRE PROTECTION SPRINKLER SYSTEM

(71) Applicant: Youssef George Bakhos, Anaheim, CA (US)

(72) Inventor: Youssef George Bakhos, Anaheim, CA (US)

(73) Assignee: Youssef G. Bakhos, Anaheim, CA (US)

( * ) Notice: Subject to any disclaimer, the term of this patent is extended or adjusted under 35 U.S.C. 154(b) by 21 days.

(21) Appl. No.: 16/415,205

(22) Filed: May 17, 2019

(65) Prior Publication Data

US 2020/0360743 A1 Nov. 19, 2020

(51) Int. Cl.
*A62C 3/02* (2006.01)

(52) U.S. Cl.
CPC ..... *A62C 3/0292* (2013.01)

(58) Field of Classification Search
CPC ..... A62C 3/0292; A62C 31/28; B05B 15/628; B05B 15/652; B05B 15/654; B05B 15/656; B05B 15/68
USPC ..... 169/52, 51, 13, 16; 239/210, 200, 225.1, 239/261, 264, 265, 273, 280, 280.5, 281
See application file for complete search history.

(56) References Cited

U.S. PATENT DOCUMENTS 1,959,886 A * 5/1934 Wadsworth ..... B05B 15/622 239/280.5
2,694,600 A * 11/1954 Richey ..... B05B 15/625 285/61
4,428,434 A * 1/1984 Gelaude ..... A62C 3/00 137/624.11
4,824,020 A * 4/1989 Harward ..... B05B 15/625 239/264
5,263,543 A * 11/1993 Nigro ..... A62C 3/00 169/16
5,836,516 A * 11/1998 Van Epps ..... B05B 15/625 239/280.5
6,322,027 B1 * 11/2001 Hsu ..... F16M 11/34 248/177.1
2011/0132405 A1 * 6/2011 Lowenstein ..... E04D 13/0765 134/21
2012/0286075 A1 * 11/2012 Brueske ..... B05B 15/628 239/722
2013/0062080 A1 * 3/2013 Tobin ..... A62C 31/28 169/46

* cited by examiner

*Primary Examiner* — Justin M Jonaitis
(74) *Attorney, Agent, or Firm* — Youssef George Bakhos

(57) ABSTRACT

Disclosed is an adjustable and portable fire protection sprinkler system. The device consists of a sprinkler head mounted on an adjustable height center pole connected to adjustable legs, forming a foldable tripod-like configuration. The legs and center pole have inner and outer tubes arranged for telescopic movement relative to each other, for adjusting the height of the pole and the lengths of the legs. The sprinkler head is connected to a rubber hose which is threaded through the top of the center pole and connected to a water source at the bottom. The tube stretches and retracts inside the pole corresponding to the pole height. A collar around the pole connected to the legs, wherein the legs connected to the end of the pole by metal strips. This allows for sliding up and down; increasing or decreasing the triangular base parameter. The base is also defined by the length of the legs and is adjusted to maintain the tripod stability.

2 Claims, 2 Drawing Sheets

PORTABLE FIRE PROTECTION SPRINKLER SYSTEM

BACKGROUND OF THE INVENTION

In recent years, wild fires have become more frequent and threatening to our civilization. These fires are extremely damaging to thousands of properties; in some cases decimating entire cities. Most importantly, these fires have been threatening human life. It is urgent that we find ways to prevent wild fires from starting, or at least, to prevent them from spreading after they've started. As any fire expert will indicate, it is not just flames but also the embers of a fire that pose a serious threat. The embers and the flaming debris can travel great distances being carried by the slightest breeze. These embers land on other dry areas and increase the spread of fires. The embers can also land on rooftops or in the eves of structures and start new fires.

Often times people stay in their homes during a fire, risking their lives, even after mandatory evacuation orders have been issued. Some have no reasonable means of escape. Some use garden hoses to soak their home and/or the surrounding area, in attempts to protect their property from the flying embers and flaming debris. Unfortunately, attempts to protect property in this way often fail. Determined property owners may install roofs with a sprinkler systems, replacing the wood shake roofs and siding, or use fire resistance building materials altogether; solutions that are very costly and often unfeasible.

It would be convenient to have a simple, easy-to-use device to help combat our impending wild fire problem. Disclosed is a device this can be used to both prevent fires from starting and extinguish fires after they've spread; protecting homes or other structures. The device is meant to be an economical alternative to the costly solutions listed earlier. This invention is a portable tripod-like sprinkler system meant to be strategically positioned to spray, mist, or soak the surrounding areas and/or structures with water or any other flame retardant, in advance and during the approaching of a fire. This invention is designed to ensure its balance and stability on the ground at different heights, angles, and fluid pressure without tipping over even when in operation during severe wind conditions.

SUMMARY OF THE INVENTION

In accordance with the disclosed claims, this sprinkler system allows the user to efficiently soak, wet, mist, or saturate a structure and the surrounding area to prevent a fire before it starts or extinguish a fire after its started. This sprinkler system is portable, adjustable, foldable, light weight, stable on the ground, efficient and affordable.

The device consists of a tripod-like structure that, when contrived, stands upright and perpendicular to the ground on which it is situated. The tubular center beam is adjustable for height. The center beam has a water source adapter at its base and a sprinkler head at its summit. The center beam is threaded with an elastic rubber hose connecting the water source adapter to the sprinkler head at the top. The elastic rubber hose maintains its integrity as it is stretched to compensate for the adjustable height of the device and the pressure of the flame retardant within it. Finally, adjustable and foldable legs at the base can be situated to maximize stability. When connected to a water source and "activated" the fluid travels up the elastic rubber hose within the center beam to the sprinkler head at the top thereby spraying the surrounding area.

It is important to note that the most unique part of this invention is the adjustable center beam containing an elastic rubber hose; the hose that maintains its integrity during the administration of the devise. The device is made of heat resistant material such as steel, aluminum, or copper. The heat resistant properties of the center beam will further protect the inner rubber tube from the elements that the device is exposed to.

To sum, a sprinkler head is mounted on the center pole of a modified tripod-like structure with three or more legs at its base. The center pole extends to a longer or shorter length to match the height of the rooftop of a structure. The sprinkler head may also be adjustable to widen the angle and increase the range of the spraying coverage. The sprinkler head is mounted at the summit of the center beam and a coupler adaptor is inserted and fastened inside the center beam of the tripod pole. The other end of the coupler is connected to a male adaptor connected to a light weight expandable flexible rubber tube threaded inside of the tripod pole. The tube stretches and contracts as the length of the tripod center pole is manually adjusted. The legs are attached to a joining collar around the tripod pole. The middle of the stationary leg tubes are connected to the end of the pole by metal strips. The pole height and the length of the legs are adjustable and locked in place by a knob locking mechanism.

When the device is in the storage and transport position, it is folded like a traditional tripod. When the user transports it to the desired location, the legs are folded outward. The legs are also extended to increase their span thereby increasing the stability of the structure. The user may then connect a home water source, for example, and adjust the height of the center beam. The user then turns on the water source and activates the device, which allows the device to wet the rooftop and soak the surrounding area by excess water dripping from the roof.

The legs constitute two sections; one stationary and one movable inserted into the other. The length of each of the legs can be adjusted separately to compensate for uneven ground; then locked into place. The user pushes down the joining collar on the pole to spread the legs and widen the base or inversely pulls up the collar to fold the legs. In order for the user to properly operate the systems, the following adjustment may be required: 1) the sprinkler angle and range, 2) the legs length, 3) the base on the ground as determined by the collar position, 4) the height of the center beam, and 5) the location of the tripod next to a dwelling or building structure. The legs may be something other than legs such as water or sand filled plastic containers. Any such base replacement would be substantially similar to this device and therefore constitute infringement.

This invention is critically designed to ensure the tripod balance and stability on the ground without tipping over when in operation under severe wind conditions. The factors considered affecting the balance and the stability of the tripod on the ground, when in operation are: 1) the height of the sprinkler head, 2) The width of the base, 3) The sprinkler head movements, 4) The water pressure, and 5) The wind conditions. The user adjusts the location of the system on the ground relative to the building, the angle and the range of the sprinkler to ensure maximum coverage of the rooftop, the base width, and the height. When the tripod is not in use, the center pole and the legs are pushed inward and retracted; so the device can be stored in a relatively small places.

The device is meant for easy transport, therefore the device may be attached to wheels to foster that attribute. The device may be equipped with heat or smoke sensor activators, and could be automated to respond to such activations.

The device may be controlled remotely using a cellular or wifi system. A user may employ the device for cleaning or insulating a structure. The device may be used to spread chemicals used to exterminate pests. The device may be used to water plants or crops.

BRIEF DESCRIPTION OF THE DRAWINGS

The drawings described herein are for illustrative purposes only of selected embodiments and are not intended to depict all possible implementations of the device. Furthermore they are not intended to limit the scope of the present disclosure.

DETAILED DESCRIPTION OF THE DRAWINGS

Figure 1:
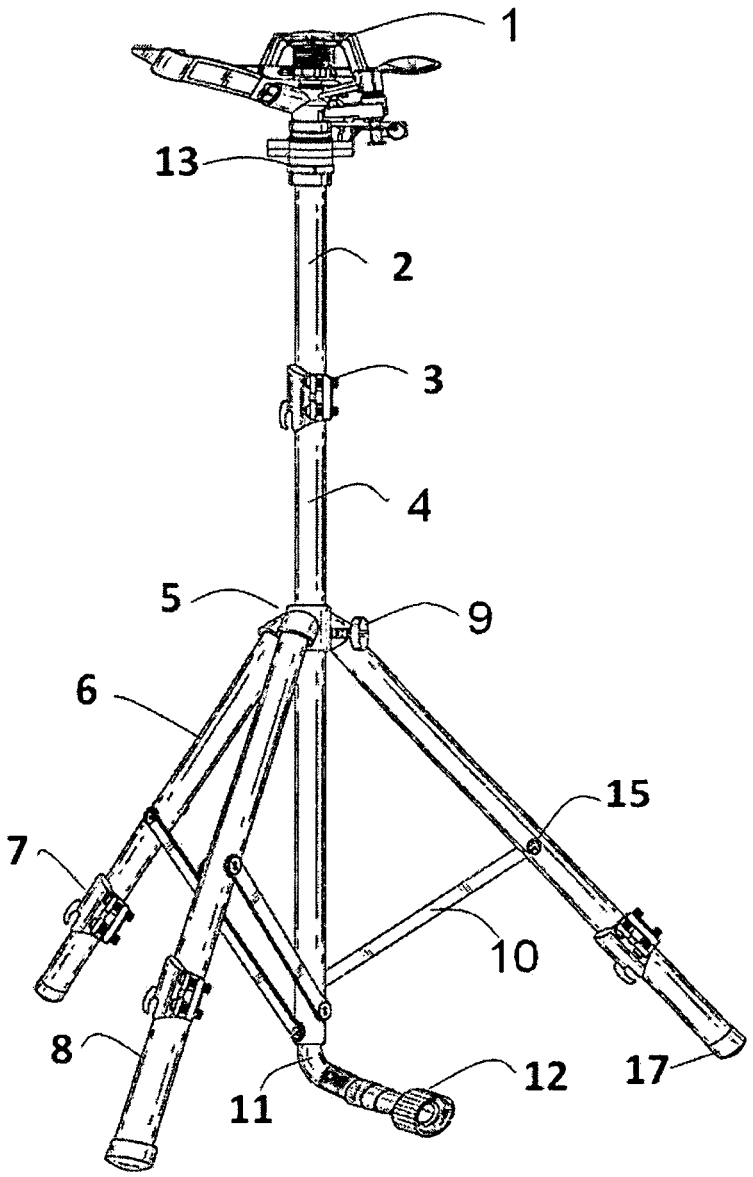
FIG. 1, is a perspective view illustrating the of the portable fire protection sprinkler system

FIG. 1, illustrate the front view of the portable fire protection sprinkler system. A sprinkler head 1, is mounted on an 11 foot length×1⅛ inch diameter tripod center beam 2 inserted into a 6 foot length×1¼ inch diameter outer tube pole 4. The outer tube 4 is stationary and inner tube 2 is movable arranged for telescopic movements relative to each other. The sprinkler height corresponds to the adjustable length of the movable inner tube 2 plus the length of the stationary tube 4. Therefore height of the sprinkler 1 may vary between 6 and 18 feet wherein adjusted and locked in place by the pole lock 3.

Similarly, the legs are adjustable and constitute a 3 foot length×⅛ inch diameter inner tube 8 inserted inside a 5 foot length×1¼ diameter stationary leg 6. Therefore the legs are adjustable between 5 and 8 feet long and locked in place with the leg lock 7. The legs 6 are connected in the middle to the joining collar 5 with metal strips 10 028 inch thickness×½ inch width×2 feet length applying screws and spacers 15. The joining collar 5 slides on the pole 4 up or down to spread or fold the legs 6, secured in position by holding knob 9. The expandable initial 10 feet long tube 11 is connected from a male adaptor 14 from one end and to a garden hose adaptor 12 from the other end. Adaptor 12 connects to a garden hose wherein connected to an outdoor faucet. The garden hose is long enough to reach and position the system in any location around the dwelling or structure. Plastic caps 17 cover the bottom of the legs.

Figure 2:
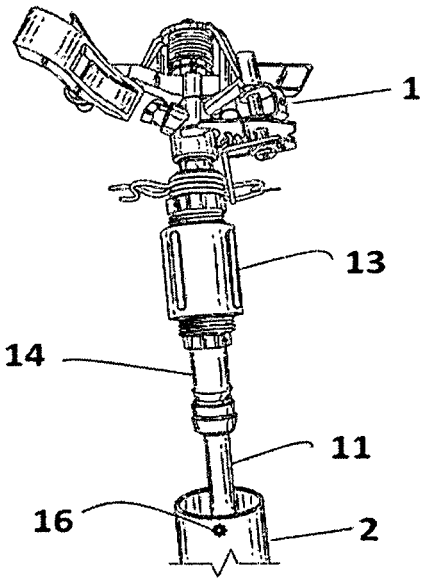
FIG. 2, is a perspective view depicting the sprinkler head and attachments

FIG. 2, illustrate the sprinkler 1 connections to the water source. Sprinkler 1 is adjustable by 360 degree rotation, and has a range of up to 85 feet soaking coverage, with a diffuser screw to control and alter the spraying distance. The sprinkler 1 is mounted to a standard ¾ inch PVC coupler 13 wherein inserted snuggly inside the pole 2 and secured by two screws 16 from outside of the pole through the PVC coupler 13. The coupler 13 connected to a male adaptor 14 from one end and to a 6 foot long expandable tube 11, from the other end wherein the rubber tube is connected to the water source adaptor 12. The rubber tube is similar to the rubber tube inside the flexible hose in the commonly known as a flexible expandable garden hose. The sprinkler 1 head is replaceable and is commercially available and marketed as Rain Bird or Orbit sprinklers.

| | | |
|---|---|---|
| 10045610 | August 2018 | Pettersson |
| 10,047,896 | August 2018 | Chu |
| D840,464 | February 2019 | Balmer |

I claim:

1. A portable Tripod like fire protection sprinkler system that, when contrived, stands upright and perpendicular to the ground comprising:

an adjustable tubular center beam having an inner tubular member and an outer tubular member arranged for vertical telescopic movement, wherein the inner tubular member has an 11 foot length, and the outer tubular member has a 6 foot length, wherein the inner tubular member includes a flame retardant source adapter at a base and an adjustable sprinkler head at a summit;

the adjustable tubular center beam including a pole lock to selectively retain a position of the inner tube relative to the outer tube, the central beam having a central beam height that can be adjusted between 6 feet and 18 feet due to the telescopic movement of the inner and outer tubular members of the adjustable tubular center beam;

an expandable and retractable rubber hose, connected to the flame retardant source adapter and configured to extend through the inside of the outer tubular member when the adjustable tubular member is extended, the expandable and retractable rubber hose supplying the sprinkler head with a flame retardant fluid;

a plurality of adjustable and foldable legs having an inner tubular member which is inserted into an outer tubular member arranged for telescopic movement, said foldable legs allowing for easy transport and increased stability of the device, wherein the inner tubular member has a length of 3 feet, the outer tubular member having a 5 foot length;

the plurality of adjustable and foldable legs including a leg lock to selectively retain a position of the inner tubular member relative to the outer tubular member, the plurality of adjustable foldable legs having a leg height that can be adjusted between 5 feet and 8 feet due to the telescopic movement of the inner and outer tubular members of the plurality of adjustable and foldable legs;

wherein the adjustable sprinkler head is adjustable by a 360 degree rotation and has a range up to 85 feet of coverage when the adjustable tubular center beam and the plurality of adjustable foldable legs are at a maximum extension.

2. The portable tripod like fire protections sprinkler of claim 1, comprising:

the sprinkler head is remotely controlled by a user using a timer or electronic activation device;

and/or a heat and/or smoke sensor tailoring an automated activation.

* * * * *